US005203795A

United States Patent [19]

Balamut et al.

[11] Patent Number: 5,203,795

[45] Date of Patent: Apr. 20, 1993

[54] WEEPHOLE VENTILATOR AND INSECT GUARD

[76] Inventors: Jay W. Balamut, 3628 Leathertop, Plano, Tex. 75075; Christopher McCrate, 3601 Racquet Ct., Plano, Tex. 75023

[21] Appl. No.: 778,249

[22] Filed: Oct. 17, 1991

[51] Int. Cl.[5] ..... E04B 1/70

[52] U.S. Cl. ..... 52/303; 43/124

[58] Field of Search ..... 52/101, 514, 303; 43/108, 121, 109, 107, 124, 58

[56] References Cited

U.S. PATENT DOCUMENTS

| | | | |
|---|---|---|---|
| 2,112,229 | 3/1938 | Davis | 43/124 |
| 2,598,194 | 5/1952 | Shippey | 52/514 |
| 2,709,402 | 5/1955 | Malm | 52/303 |
| 2,782,464 | 2/1957 | Joppich | 52/303 |
| 3,257,929 | 6/1966 | Cortvely | 98/29 |
| 3,295,285 | 1/1967 | Metz | 52/514 |
| 3,429,084 | 2/1969 | Brewer | 43/121 |
| 4,102,093 | 7/1978 | Harris | 52/101 |
| 4,282,691 | 8/1981 | Risdon | 52/101 |
| 4,406,107 | 9/1983 | Schoonbeck | 52/514 |
| 4,587,891 | 5/1986 | Kruse | 98/29 |

FOREIGN PATENT DOCUMENTS

| | | | |
|---|---|---|---|
| 0675921 | 12/1963 | Canada | 52/514 |
| 1176819 | 8/1964 | Fed. Rep. of Germany . | |
| 2206420 | 8/1973 | Fed. Rep. of Germany | 52/354 |
| 0499691 | 1/1939 | United Kingdom . | |
| 0911554 | 11/1962 | United Kingdom | 50/420 |

*Primary Examiner*—Richard K. Seidel
*Assistant Examiner*—James Miner
*Attorney, Agent, or Firm*—John E. Vandigriff

[57] ABSTRACT

This invention is a weephole ventilation device that permits evaporation of moisture that would otherwise collect within the wall cavity, while incorporating an insect and rodent barrier. It is designed to be installed after completion of exterior masonry walls. The invention consists of a perforated cover plate, a sealing gasket, a novel anchoring device, and a threaded fastener. The perforated cover plate and sealing gasket sub-assembly form an external barrier to insect, rodent and water penetration, and are held to the masonry wall by the threaded fastener and anchoring device. The threaded fastener passes through the perforated cover plate sub-assembly and tightens into the anchor. The anchor is an innovative device that wedges into rifts or fissures in masonry or other surfaces and provides a surface for the attachment of objects.

8 Claims, 2 Drawing Sheets

WEEPHOLE VENTILATOR AND INSECT GUARD

BACKGROUND OF THE INVENTION

1. Field of the Invention

This invention is a ventilating device. More specifically the invention addresses ventilation of wall cavities between exterior masonry, brick, brick veneer structures, and the like, and an interior wall structure. Additionally the invention provides an insect and rodent resistant barrier.

Exterior masonry construction practices typically utilize 'weepholes' as a preferred method of ventilation. Weepholes are gaps intentionally left between the ends of adjoining bricks at predetermined intervals. A typical weephole amounts to no more than a crevice created by omission of mortar between adjacent bricks Weepholes provide an air passage between an outer masonry wall and an interior wall, allowing air to circulate therein, thus evaporating moisture from within a wall cavity. Evaporation of moisture is essential in preventing mildew and rot damage to an interior wall. A weephole is prone to insect and rodent intrusion, blockage due to insect nest building, collection of miscellaneous debris as the structure ages, and excessive water penetration via driving rain and sprinklers.

2. Description of the Prior Art

U.K. (Aus.) Pat. No. 0,499,691 by Chatsworth discloses improvements to ventilating devices, incorporating integrally formed engaging means. Canadian Pat. No. 0,675,921 by Fork teaches a closure assembly with a cover plate, gasket, screw, and a "M" shaped retaining spring. U.S. Pat. No. 2,598,194 by Shippey reveals perforated disks and a mounting clamp that forms a base for repair material. U.S. Pat. No. 2,709,402 by Malm teaches a wall mounted ventilator using a series of spaced parallel prongs as a fixing means. U.S. Pat. No. 3,257,929 by Kortvely makes known a brick veneer weephole ventilator comprised of a single piece of sheet material installed during wall construction. U.S. Pat. No. 3,295,285 by Metz reveals a plaster wall repair plate using various spring wire elements and attaching hooks. U.S. Pat. No. 3,429,084 by Brewer teaches an insect-proof weephole installed during wall construction, featuring a replaceable screen unit. U.S. Pat. No. 4,102,093 by Harris instructs on an insect control system by insertion of a perforated sheet member into a weephole with a special tool. U.S. Pat. No. 4,282,691 by Risdon illustrates a weephole device utilizing a wick, tube, and screen cap. U.S. Pat. No. 4,406,107 by Schoonbeck discloses perforated disks for repairing holes in plaster walls. U.S Pat. No. 4,587,891 by Kruse teaches a ventilating device that incorporates a tubular member and a screened bottom.

SUMMARY OF THE INVENTION

This invention pertains to ventilation of masonry walls, brick walls, brick veneer structures, and the like, possessing weepholes. Primary objectives of the weephole ventilator and insect guard are to provide adequate ventilation, to deny insect and rodent invasion, and to reduce exterior water penetration.

Additional objectives are the ability for installation after completion of the masonry structure, simplicity of installation and removal, and accommodation of weepholes of varying dimensions.

Additionally, the invention incorporates a novel anchor that provides a means of fastening objects onto surfaces having clefts, rifts or fissures.

The weephole ventilator and insect guard embodied in this invention is comprised of a perforated cover plate, an anchoring means, a sealing gasket, and a threaded fastener. The novel anchor is inserted into a weephole and supplies the mean by which the perforated plate is affixed to the wall. The anchor includes a flange incorporating a hole into which a screw is engaged to draw the plate tightly against the wall. The gasket is a hollow shape that follows the outline of the perforated cover plate and is compressed between the exterior wall surface and the interior of the plate, forcing ventilation to occur through the perforations in the cover plate.

BRIEF DESCRIPTION OF THE DRAWINGS

Explanation of the invention and its advantages will be apparent from the following description taken in conjunction with the drawings, wherein.

DESCRIPTION OF THE PREFERRED EMBODIMENTS

Figure 1:
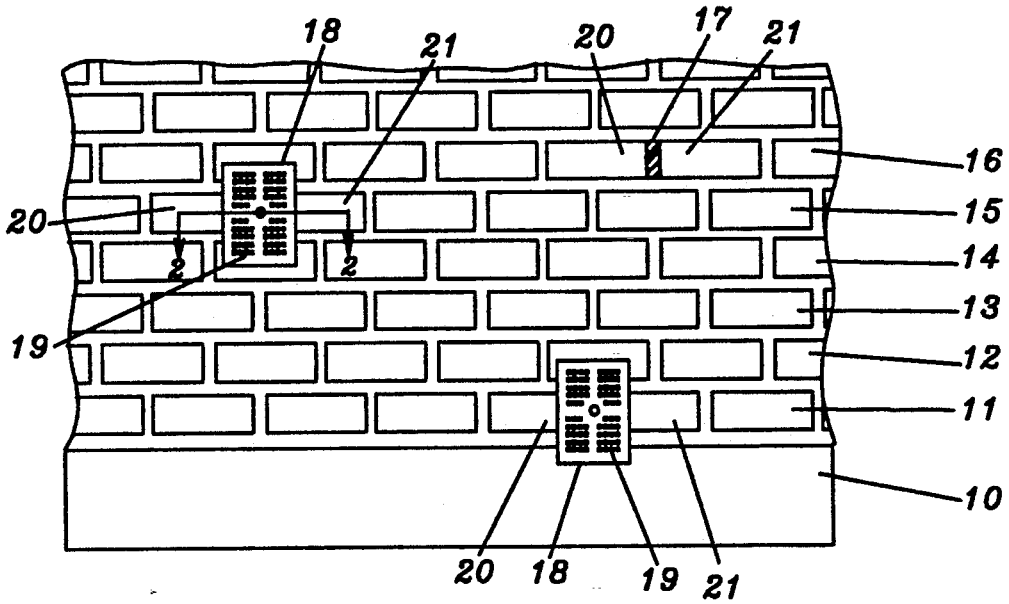
FIG. 1 is a partial view of a brick veneer wall showing examples of possible weephole cover mounting applications.

With reference to the drawings, FIG. 1 shows a section of brick veneer wall, including the foundation 10, a typical exposed weephole 17, Several brick courses 11, 12, 13, 14, 15, and 16, and two weephole covers 18 in place. The typical weephole 17 is formed when mortar is omitted between adjoining bricks as at 20 and 21. A weephole may exist along the course of bricks 11 at foundation level, or at any other horizontal course of bricks as specified by the construction engineer. This invention will perform its intended function on weepholes in virtually any location on a wall.

Figure 3:
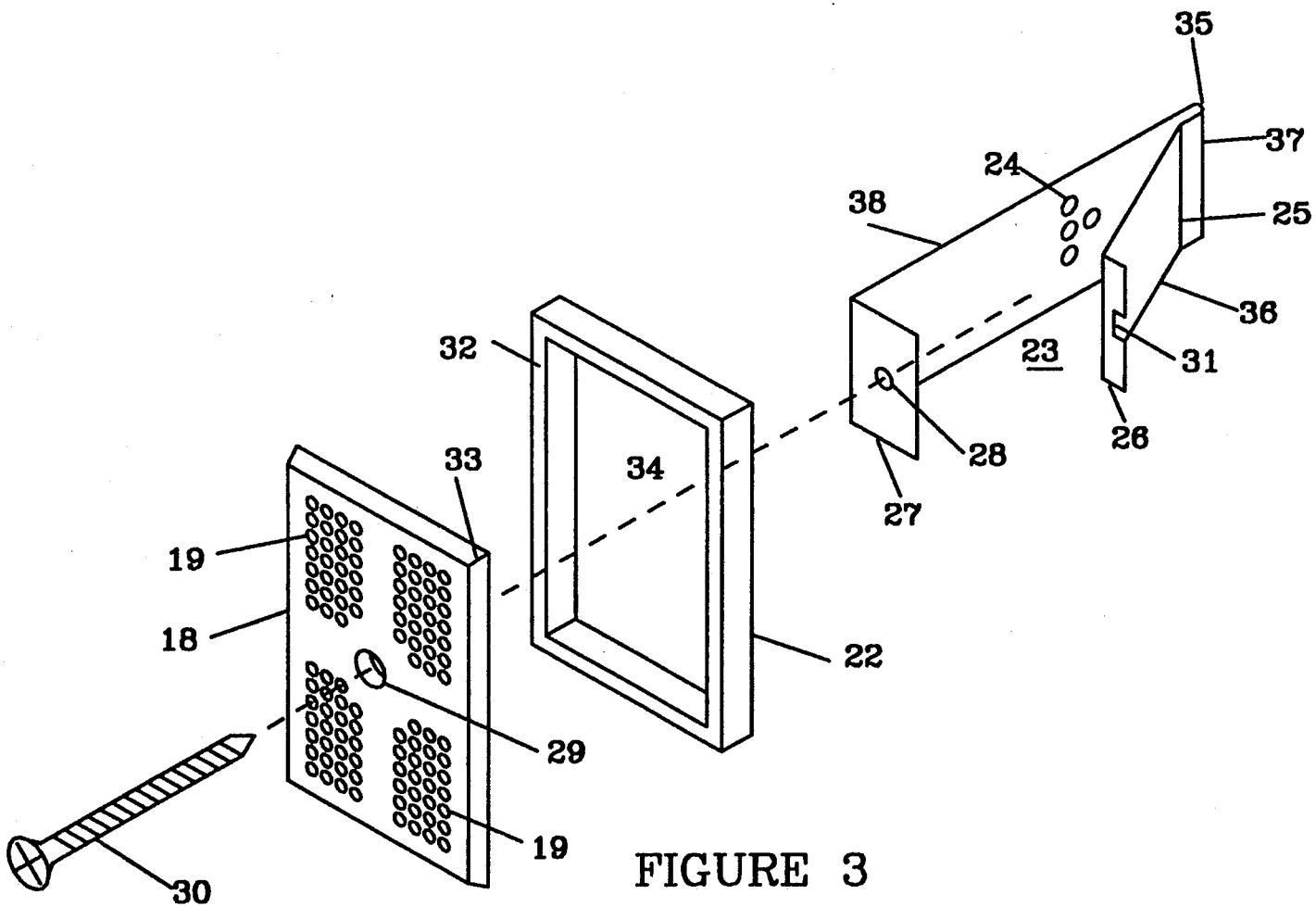
FIG. 3 is a perspective view of the weephole cover plate, screw, gasket, and anchor.

FIG. 3 shows the components of the invention, that include a cover plate 18, a sealing gasket 22, an anchor 23, with all three components held in place by the action of threaded fastener 30 through hole 29 of cover plate 18 threading into hole 28 of anchor 23.

FIG. 3 threaded fastener 30 is of stainless steel or other corrosion resistant material.

Cover plate 18 of FIG. 3 is a plate of generally rectangular or ellipsoid shape when viewed from the front. It can be constructed in virtually any frontal shape required. The rectangular variation is depicted in FIG. 3, and the following dimensions are examples of typical residential applications but are for reference only and not intended to limit the design of this invention. Cover plate 18 is nominally 4.750 inches tall by 3.000 inches wide by 0.125 inches deep. Characteristics of cover plate 18 are: ventilation holes 19, countersunk hole 29, and reinforcing beveled edges 33. Cover plate 18 is constructed of either light gauge metal or other suitable polymer material, and can be painted or color molded as required. The edges of cover plate 18 are angled at 45 degrees toward the rear surface of the plate, forming a continuous reinforcing edge around the entire perimeter, as indicated in FIG. 3 item 33 and in the top view section in FIG. 2 item 33. The ventilation holes 19 are a series of small perforations through cover plate 18 and are of suitable quantity and diameter to provide both adequate wall cavity ventilation and an effective insect and rodent barrier. In a molded polymer material embodiment of the cover plate 18, the ventilation holes 19 will be angled at a 45 degree slope downward, with the high side at the back of the cover plate. This will not impede the invention's ability to ventilate, while adding significantly to water penetration protection that may occur due to driving rain or lawn sprinklers.

Gasket 22 of FIG. 3 is composed of cellular foam and is compressed to form a seal between perforated cover plate 18 and the brick wall surface in FIG. 1. The gasket 22 is rectangular or ellipsoidal to match the shape of cover plate 18, and is designed so as to form a void in the center as depicted in FIG. 3 item 34. This void permits air to flow through holes 19 in perforated cover plate 18. The following dimensions are examples of typical residential applications but are for reference only and not intended to limit the design of this invention. Gasket 22 is nominally 4.500 inches tall by 2.750 inches wide by 0.750 inch deep. Gasket surface 32 of FIG. 3 is nominally 0.500 inch wide, and the surface facing cover plate 18 may have an adhesive coating to accurately align and hold gasket 22 to the back of cover plate 18 as depicted in FIG. 3. Affixing gasket 22 to cover plate 18 will aid during subsequent installation of the invention. The gasket 22, when compressed, provides insect and rodent penetration protection between the cover plate and the exterior wall surface.

Figure 2:
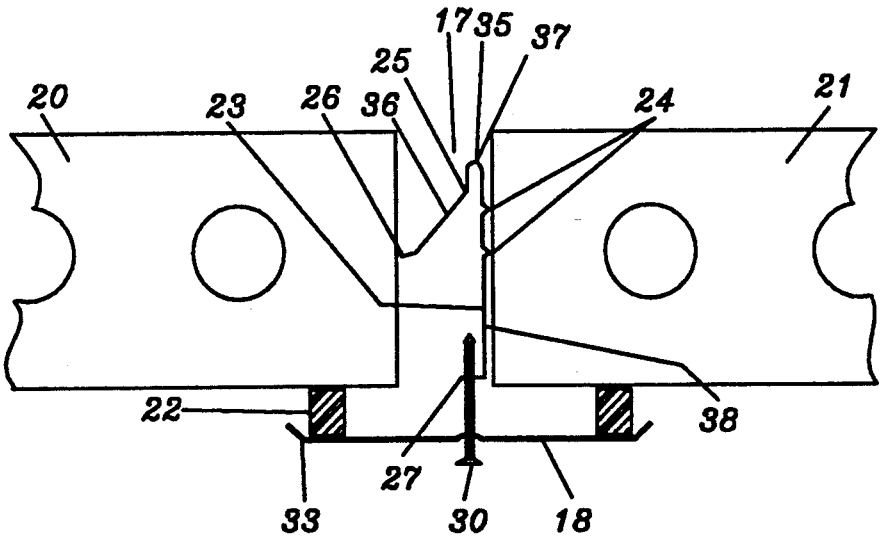
FIG. 2 is a top view taken along line 2—2 from FIG. 1.

The anchor 23 of FIG. 3 is a sophisticated "V" shaped wedging device providing a base that retains cover plate 18 against the external surface of the brick wall in FIG. 1. Referring to FIGS. 2 and 3, the leading edge 37 of anchor 23 is inserted into the weephole by pressing on the flange 27 so that the tension arm 36 is compressed longitudinally at bend 25. Additional springing force is applied on tension arm 36 by compression of leading edge 37 bend 35. Referring to FIG. 2, the anchor 23 is inserted into the weephole so that flange 27 is flush with the exterior surface of the brick wall, or slightly inset into the weephole if the weephole width is greater than the width of flange 27. Anchor 23 as depicted in FIGS. 2 and 3 will accommodate weepholes varying in width from 0.125 inch to 0.750 inch as is typical in residential brick masonry construction. However, basic dimensions of the anchor 23 can be proportionately incremented or decremented to fit a virtually unlimited variety of rectangular apertures.

Anchor 23 is wider than the weephole within which it is inserted, causing the anchor's side 38 and tension arm 36 to bear against the opposing internal sides of the weephole. When cover plate 18 is fastened to the brick wall via screw 30 threading into hole 28 of flange 27 of anchor 23, the natural tendency is for anchor 23 to be pulled out of the weephole. This tendency is counteracted by the action of flange 26 bearing against and digging into one interior brick surface of the weephole, and the friction of the perforations 24 caused by the springing force imparted by arm 36 at bends 25 and 35 on the other weephole side. The perforations 24, as shown in FIGS. 2 and 3, are punched completely through the anchor's material, creating a ragged edge around the entire perimeter of the perforation. These ragged perforations greatly enhance the anchor's ability to remain solidly fixed within the cavity of the weephole, providing a firm surface for mounting the cover plate 18 and sealing gasket 22.

Referring to FIG. 2, the installation process follows: The anchor is inserted into the selected weephole by placing leading edge 37 into the weephole vertically. Grasping flange 27, either by hand or with a tool such as pliers, forward pressure is applied, thus forcing arm 36 to compress along the vertical axis of bend 37 as it penetrates the airspace of the weephole. The object is to push anchor 23 into the weephole until flange 27 is embedded within the vertical plane of the wall. An exception to this is if the weephole is narrower horizontally than flange 27 is wide, the anchor can be pushed flush with the wall and still function properly. Anchor 23 is now a solid mounting base for the cover plate 18. Referring to FIG. 3, sealing gasket 22 may be attached to cover plate 18 via adhesive coating on surface 32 of the gasket. Threaded fastener 30 is inserted through hole 29 of cover plate 18 and initially threaded into hole 28 of flange 27 of anchor 23. Finally, the cover plate and gasket assembly is compressed by hand against the wall, while threaded fastener 30 is tightened into hole 28. As the threaded fastener draws into hole 28, pulling the plate and gasket to the wall, the gasket compresses to seal irregularities around the weephole. Threaded fastener 30 is tightened until effective sealing is achieved without warping the cover plate.

Two concepts inherent in the design are that the device is intended to be installed after construction of the brick surface, and it can be removed and replaced should it become damaged. This is in contrast to most other products available that must be permanently installed during construction.

An additional feature of the anchor 23 is notch 31 in flange 26, which permits extraction of the anchor by first removing the threaded fastener 30, cover plate 18, and sealing gasket 22. Then anchor 23 is removed by inserting a flat-bladed screwdriver tip or similar flat-bladed tool into the gap formed between the brick surface and notch 31, slightly twisting the tool, and at the same time pulling the anchor out of the weephole. Threaded fastener 30 can be inserted into hole 28 and tightened a few turns to be used as a handle during this extraction process.

What is claimed is:

1. A weephole device for the ventilation of cavities between exterior masonry, brick, and brick veneer wall structures, and an interior wall structure, comprising:

- a perforated cover plate wherein said perforations provide a ventilating means;
- a sealing gasket filling surface imperfections between the perforated cover plate and an exterior wall surface;
- a "V" shaped wedging anchor providing a solid base from within a weephole cavity for mounting the perforated cover plate and the sealing gasket to an exterior wall surface; and
- a threaded fastener, extending through said perforated cover plate and said sealing gasket, attached to said wedging anchor, securing and sealing the perforated cover plate with said sealing gasket against the exterior wall surface.

2. A weephole device as claimed in claim 1 wherein said perforated cover plate is of greater width and height so as to extend beyond horizontal and vertical dimensions of a weephole.

3. A weephole device as claimed in claim 1 wherein said sealing gasket is the same shape as the said perforated cover plate, slightly reduced in overall width and height, with a void in its center.

4. A weephole device as claimed in claim 1 wherein said wedging anchor is a stamped, one-piece design, constructed of flexible, yet resilient material, that when viewed from the top resembles a "V" shape having first and second sides, said wedging anchor is wider across the open gap of the "V" than the width of a weephole, said wedging anchor, when viewed from a side, has a height greater than the width of a weephole, and has a height less than the height of a weephole.

5. A weephole device as claimed in claim 4 wherein said first side of said "V" shaped wedging anchor is longer than the second side.

6. A weephole device as claimed in claim 5 wherein said wedging anchor incorporates a flange and a hole; said flange, as viewed from the top, is an extension of said first side, bent toward the interior of the "V", and the width of the flange is marginally greater than the diameter of the aforementioned hole.

7. A weephole device as claimed in claim 5 wherein said "V" shaped wedging anchor incorporates a flange and a notch; said flange, as viewed from the top, is an extension of said second side, bent outwardly from the "V"; said notch is a rectangular cut out in the vertical outermost edge of the aforementioned flange as viewed from the side.

8. A weephole device as claimed in claim 5 wherein said "V" shaped wedging anchor incorporates perforations in said first side; said perforations are formed in such a manner as to result in ragged edges; said ragged edges extending toward the exterior of the "V".

* * * * *